US005474348A

United States Patent [19]

Palmer et al.

[11] Patent Number: 5,474,348

[45] Date of Patent: Dec. 12, 1995

[54] MOTORIZED ACTUATOR FOR MORTISE LOCKSET

[75] Inventors: Ralph P. Palmer, Indianapolis; Lyn E. Hamel, Pendelton, both of Ind.

[73] Assignee: Best Lock Corporation, Indianapolis, Ind.

[21] Appl. No.: 110,981

[22] Filed: Aug. 24, 1993

[51] Int. Cl.[6] ..... E05B 13/00

[52] U.S. Cl. ..... 292/339; 292/169.15; 292/DIG. 24; 292/144; 70/283

[58] Field of Search ..... 292/359, 169.14, 292/169.15, DIG. 27, DIG. 24, 144, 27, 150, 145; 70/283

[56] References Cited

U.S. PATENT DOCUMENTS

| | | | |
|---|---|---|---|
| 3,529,454 | 9/1970 | Fish . | |
| 3,656,327 | 4/1972 | Ford et al. | 70/150 |
| 3,733,861 | 5/1973 | Lester | 70/277 |
| 3,790,196 | 2/1974 | Sanders et al. | 292/169.15 |
| 3,854,763 | 12/1974 | Zawadzki et al. | 292/144 |
| 3,876,236 | 4/1975 | Best et al. | 292/169.13 |
| 3,894,417 | 4/1975 | Taniyama | 70/277 |
| 3,939,679 | 2/1976 | Barker et al. | 70/277 |
| 3,955,387 | 5/1976 | Best et al. | 292/336.3 |
| 4,073,527 | 2/1978 | Schlage | 292/144 |
| 4,294,089 | 10/1981 | Best et al. | 70/150 |
| 4,301,667 | 11/1981 | Best et al. | 292/169.15 |
| 4,318,558 | 3/1982 | Best et al. | 292/163.13 |
| 4,390,197 | 6/1983 | Butts | 292/169.15 |
| 4,529,234 | 7/1985 | Senften | 292/169.15 |
| 4,572,556 | 2/1986 | Foshee . | |
| 4,589,691 | 5/1986 | Foshee et al. | 292/150 |
| 4,656,850 | 4/1987 | Tabata | 292/DIG. 27 |
| 4,671,087 | 6/1987 | Olenfalk et al. | 292/336.3 |
| 4,736,970 | 4/1988 | McGourty et al. | 70/283 |
| 4,773,240 | 9/1988 | Foshee | 70/224 |
| 4,779,908 | 10/1988 | Foshee et al. | 292/169.13 |
| 4,810,014 | 3/1989 | McGourty et al. | 292/359 |
| 4,920,773 | 5/1990 | Surko | 70/224 |
| 4,946,207 | 8/1990 | Gillham | 292/359 |
| 5,018,375 | 5/1991 | Tully | 70/224 |
| 5,083,122 | 1/1992 | Clark | 70/278 |
| 5,228,730 | 7/1993 | Gokoebay et al. | 292/150 |

*Primary Examiner*—Peter M. Cuomo
*Assistant Examiner*—Barnell M. Boucher
*Attorney, Agent, or Firm*—Barnes & Thornburg

[57] ABSTRACT

A motorized lock actuator is provided for moving a locking bar in a mortise lock. The lock actuator includes a pivot hub having a pivot axis and a shaft-receiving aperture, a spring mounted on the pivot hub, a motor, and a rotatable drive shaft inserted into the shaft-receiving aperture formed in the pivot hub. The motor rotates the drive shaft and thus the pivot hub to urge the spring into engagement with the locking bar so that the locking bar is moved either to its locked or unlocked position. A slip-clutch mechanism is provided in the pivot hub to establish a driving connection between the drive shaft and the pivot hub.

45 Claims, 4 Drawing Sheets

MOTORIZED ACTUATOR FOR MORTISE LOCKSET

BACKGROUND AND SUMMARY OF THE INVENTION

This invention relates to a lockset for operating a latch bolt retractor mounted in a door, and particularly to a motorized lock actuator for electrically locking and unlocking a mortise lockset. More particularly, this invention relates to a door-mounted mortise lockset having an outside door handle that can be locked against rotation using an electromechanical lock actuator mechanism mounted in the mortise lockset.

Mortise locksets are well known and usually include various internal linkages and mechanical mechanisms for connecting a door handle to a retractable latch bolt. For example, mortise locks are disclosed in U.S. Pat. Nos. 4,572,556 and 4,589,691. Typically, a mortise lockset includes a rectangular case that fits into a cavity cut into a wooden door (or provided in a hollow metal door). The rectangular case contains the retractable latch bolt and the latch bolt retraction mechanism as well as some other components. Turning the door handle on a closed door causes the retraction mechanism to retract the latch bolt into the mortise lockset case mounted in the closed door so that the door is free to swing on its hinges to an opened position.

A locking mechanism of some kind is usually mounted in the mortise lockset and operated to control locking and unlocking of the outside door handle. One type of locking mechanism is actuated using a key and another type of locking mechanism is actuated using a push-button assembly. The key-actuated locking mechanism usually includes a lock cylinder attached to the mortise lockset and arranged to provide a keyway on the side of the door so that a person standing outside a closed door can insert a key into the keyway and turn the key either to lock or unlock the mortise lockset. The button-actuated locking mechanism usually includes a pair of push buttons attached to the mortise lockset and mounted in the vertical edge of the door in a place near the door handle so that the buttons can be pushed manually as long as the door is opened either to lock or unlock the mortise lockset. It is common to see mortise locksets outfitted with both key-actuated and button-actuated locking mechanisms.

It is also known to use a motor with a mortise lockset to control locking and unlocking of the outside doorknob or handle. Typically, such motor-controlled locking mechanism replaces the conventional manual button-actuated locking mechanism and is used in parallel with a conventional key-actuated locking mechanism. See, for example, U.S. Pat. No. 3,529,454 to Fish, U.S. Pat. No. 3,656,347 to Ford et al., U.S. Pat. No. 3,733,861 to Lester, and U.S. Pat. No. 3,854,763 to Zawadzki et al., for descriptions of electromechanical locking mechanisms.

Conventional electrified or battery-operated mortise locksets could potentially fail to function properly as a result of several problems that affect the operation of the electrical and mechanical locking mechanisms in such mortise locksets. As a result, an improved motorized mortise lockset is needed. It would be desirable to have a motorized mortise lockset that includes adequate, positive deadlocking features to ensure that the lockset remains securely locked whenever it is exposed to severe vibrational attack. Consumers would appreciate an improved motorized mortise lockset that includes a reliable auxiliary mechanical override system for locking and unlocking the lockset when mechanisms in the lockset become misaligned or jammed. Consumers also desire a battery-operated motorized mortise lockset that is designed to minimize energy consumption so that battery life is extended and that is also designed to come apart and go back together easily so that the lockset can be serviced or modified easily by the consumer or service technicians.

Lever handles are often used on mortise locks to ensure that such locks are operable by persons who have difficulty operating a doorknob which can be turned only by tightly gripping the knob. One problem is that hoodlums often exert tremendous force on such a lever handle, for example, by hitting it with a hammer or turning it using a long pipe in an attempt to vibrate and break the locking mechanism contained in the mortise lockset. What is needed is an electromechanical locking mechanism suitable for use in a mortise lockset that is sturdy enough to survive a vibration attack on the lockset and is mounted inside a mortise lock case so as to be protected from exposure to the environment. It is generally recognized that there may be problems that could affect the operation of certain types of motorized mortise locksets in the field over extended periods of time. In part, these problems could occur in these mechanisms due to their tendencies to be somewhat sensitive to motor timing on/off variations.

In an attempt to reduce these timing sensitivities, some types of locksets may utilize motor control systems which can be programmed to purposely energize the motor for an extended period of time. Although this would tend to minimize timing sensitivity, it can adversely consume additional battery energy thereby draining the motor batteries prematurely. It is generally accepted that, it is undesirable for the customer to frequently replace the batteries.

In addition, motor timing problems may cause disfunction of the lockset which could cause an operator attempting to actuate the lockset electrically to pause and repeat this lock actuating process in an effort to actuate the lockset.

Furthermore, there may exist conditions with certain electrically motorized locksets which allow the motor to become temporarily stalled. This temporary stalling can cause unwanted damage to the motor mechanism and can also adversely affect battery life. Sensors are sometimes used in certain locksets in an attempt to prevent or minimize these timing/stalling conditions, however, they tend to further complicate the overall design which results in higher cost to the customer.

Also, there is always the problem of motor stalling caused by overdriving an electromechanical linkage should it encounter an unexpected obstruction and become bound up or jammed as it tries to move within the lockset between a door-unlocking position and door-locking position. For example, these conventional linkages can often become jammed if excessive torque is applied to the outside doorknob or handle manually by someone holding the outside knob or handle before and/or during the locking of the lockset using the electromechanical locking mechanism.

A motorized lock actuator able to move a locking lug or the like in a mortise lockset to lock or unlock a door handle without stalling or damaging the miniature lock actuator motor or impairing operation of the lockset would be a welcomed improvement. Moreover, mortise locksets could be improved by providing a motorized lock actuator having a compact size and simple construction and a configuration designed to fit inside conventional mortise lockset cases. Such a design would make it possible for current owners of many conventional fully mechanical mortise locksets to retrofit such locksets with new motorized lock actuators in accordance with the present invention without a lot of trouble or expense.

According to the present invention, an improvement is provided for use in actuating a locking bar in a mortise lockset. The improvement includes means for moving the locking bar between door handle-locking and door handle-unlocking positions. The moving means includes a pivot hub having a pivot axis, a spring mounted on the pivot hub, and means for rotating the pivot hub about the pivot axis in either a clockwise or counterclockwise direction. To lock the mortise lockset, the pivot hub is rotated in a first "locking" direction by the rotating means to urge the spring into engagement with a first surface on the locking bar to move the locking bar to its door handle-locking position. Alternatively, to unlock the mortise lockset, the pivot hub is rotated in a second "unlocking" direction by the rotating means to urge the spring into engagement with a second surface on the locking bar to move the locking bar to its door handle-unlocking position.

In preferred embodiments, the rotating means includes an electric motor mounted in the lockset and a rotatable drive shaft driven by the motor. A slip-clutch mechanism joins the rotatable drive shaft to the pivot hub and normally functions to rotate the pivot hub about the pivot axis in response to rotation of the drive shaft by the motor. Illustratively, the drive shaft extends through an aperture formed in the pivot hub and the slip-clutch mechanism is retained in an internal chamber formed in the pivot hub.

Illustratively, the spring includes a base mounted on the pivot hub and a flexible cantilevered body extending away from the pivot hub and into an aperture formed in the locking bar. The cantilevered body of the spring includes a pair of cam surfaces that are positioned to lie in the locking bar aperture and sized to be movable in the aperture to reach and engage either the first or second surface on the locking bar during rotation of the pivot hub about its pivot axis. A "leading" cam surface is appended to the distal end of the cantilevered body and arranged to engage the first surface on the locking bar during rotation of the pivot hub in the first direction to move the locking bar to its door handle-locking position. A "trailing" cam surface is appended to the leading cam surface and arranged to engage the second surface on the locking bar during rotation of the pivot hub in the opposite second direction to move the locking bar to its door handle-unlocking position.

In use, the motor is used to rotate the pivot hub and spring in the first direction so as to advance the locking bar to its door handle-locking position due to camming engagement between the spring and the locking bar. One unique aspect of the invention is that the spring will behave as a fairly stiff member and move the locking bar to its door handle-locking position in response to motor-driven rotation of the pivot hub in the first direction. However, the spring is designed to be flexed between the locking bar and the pivot hub whenever an obstruction blocks movement of the locking bar in a locking direction and the motor continues to move the pivot hub and the spring. This flexure causes potential energy to be stored in the spring. Upon removal of the obstruction, the spring is designed to release and move the now freely movable locking bar to its handle-locking position. The spring also flexes and releases in the foregoing manner if movement of the locking bar is obstructed during use of the motor to move the locking bar in an unlocking direction to a door handle-unlocking position.

Advantageously, obstruction of the locking bar is not expected to hinder movement of the pivot hub or impair operation of the motor or lockset. The motor always rotates the pivot hub to a home position in either the locking or unlocking direction every time the motor is actuated. This is possible because the spring flexes relative to the pivot hub if movement of the locking bar is obstructed during motor-driven rotation of the pivot hub. Therefore, stalling of or damage to the motor and impairment of the operation of the lockset is minimized because of the novel way in which a spring is used to move the locking bar as the motor rotates the pivot hub between handle-locking and handle-unlocking positions. Thus, the spring functions as part of a reliable mechanical override system that is designed to provide a positive method of engaging and disengaging locking parts during misalignment or jamming conditions.

The slip-clutch mechanism eliminates the need for precise energized timing of the motor, thereby reducing the overall sensitivity of the motorized mortise lockset. Further, the slip-clutch mechanism is designed to provide low energy-consuming torque and is extremely resistant to frictional wear for maximum life.

The motors rotating pivot hub, and spring in accordance with the present invention are easily mounted in certain conventional mortise locksets to permit such a lockset to be converted from a fully mechanical lock actuator to a motorized lock actuator in the field or in the shop. Most importantly, any obstruction of the locking bar as it moves in the mortise lockset between its door handle-locking and door handle-unlocking positions does not disrupt operation of the motor, rotation of the pivot hub, or operation of the spring. This lengthens the life of the motor and minimizes disfunction of the motorized lock actuator.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
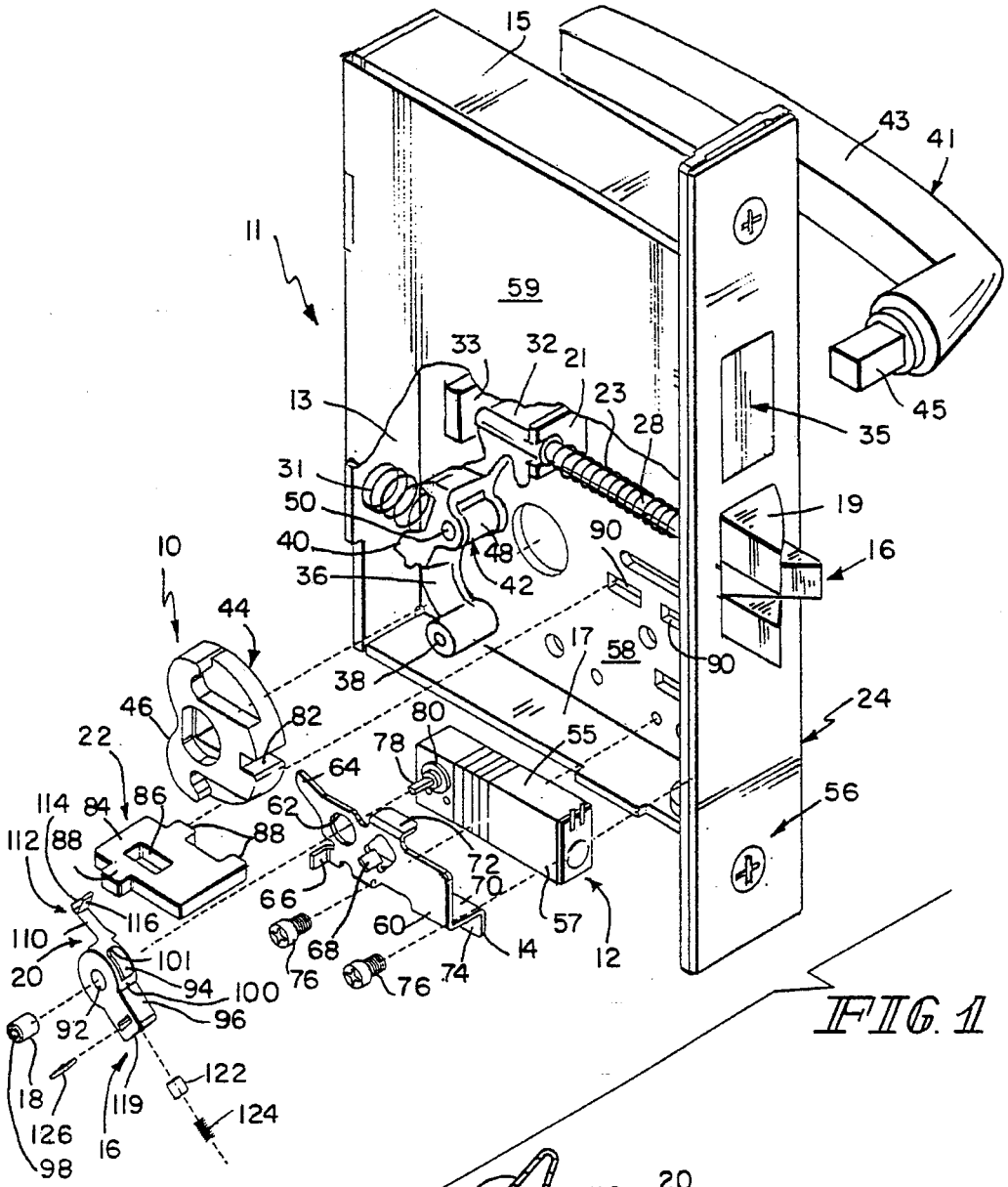
FIG. 1 is an exploded perspective view of a mortise lockset including a spring-biased latch bolt, a latch bolt retractor and hub assembly, a locking bar movable to lock and unlock the latch bolt retractor and hub assembly, and an improvement in accordance with the present invention for moving the locking bar between door handle-locking and unlocking positions using a motor and battery pack, a pivot hub, and a spring mounted on the pivot hub.

A motorized actuator 10 is mountable in a mortise lockset 11 as shown in FIG. 1. The motorized actuator 10 is operable to lock and unlock the lockset 11 by remote control as shown in FIGS. 3–7.

The motorized actuator 10 includes a motor assembly 12, a motor mount 14, a pivot hub 16, a pivot hub bearing 18, a locking bar spring 20, and a locking bar 22. The motorized actuator 10 is positioned inside a mortise lock case 24 to engage and operate a latch bolt retraction mechanism 25 positioned in the mortise lock case 24 and connected to latch bolt 26. The motor assembly 12 can be energized by a battery (not shown) concealed in door trim (not shown) adjacent to the mortise latch case 24 or by another source of power (not shown). In use, the pivot hub 16 pivots about bearing 18 in response to operation of motor assembly 12 to cause the locking bar spring 20 to slide the locking bar 22 back and forth inside lock case 24 between a door handle-locking position shown in FIG. 3 and a door handle-unlocking position shown in FIG. 4.

The latch bolt retraction mechanism 25 includes a retraction lever 30 and a lever spring 31. The retraction lever 30 is mounted to pivot inside lock case 24 and retracts the latch bolt 26 into the lock case 24. Retraction lever 30 includes a nose portion 32 in engagement with a flange 33 on a tail piece 28 of the latch bolt 26 at a tail piece contact point 34, a pivot portion 36 mounted on a pivot 38 in the lock case 24, and a middle portion 40 located between the nose portion 32 and pivot portion 36. The retraction lever 30 can be pivoted to retract the latch bolt 26 into lock case 24 either by turning the outside door handle 41, turning the inside door handle (not shown), or activating the motorized actuator 10.

A cam follower 42 is coupled to the retraction lever 30 at the middle portion 40. An outside operating hub 44 is mounted in the lock case 24 for independent rotation (as shown by arrows 45 in FIG. 4) and is rotatable in at least one direction toward a rotated position. The operating hub 44 includes a heart-shaped cam surface 46 and the retraction lever 30 includes a cam follower 42 pushed into engagement with the cam surface 46 on hub 44 by lever spring 31. The cam follower 42 rides on the cam surface 46 of hub 44 during rotation of the hub 44 to cause the retraction lever 30 to pivot and retract the latch bolt 26 against the biasing spring 23 and into the lock case 24. The cam follower 42 includes a roller 48 and a shaft 50 for rotatably mounting the roller 48 on the retraction lever 30 to engage the cam surface 46 to define a floating hub contact point 52. The tail piece contact point 34 and hub contact point 52. cooperate to define an effective lever arm of substantially constant dimension therebetween irrespective of the direction of hub rotation.

Figure 3:
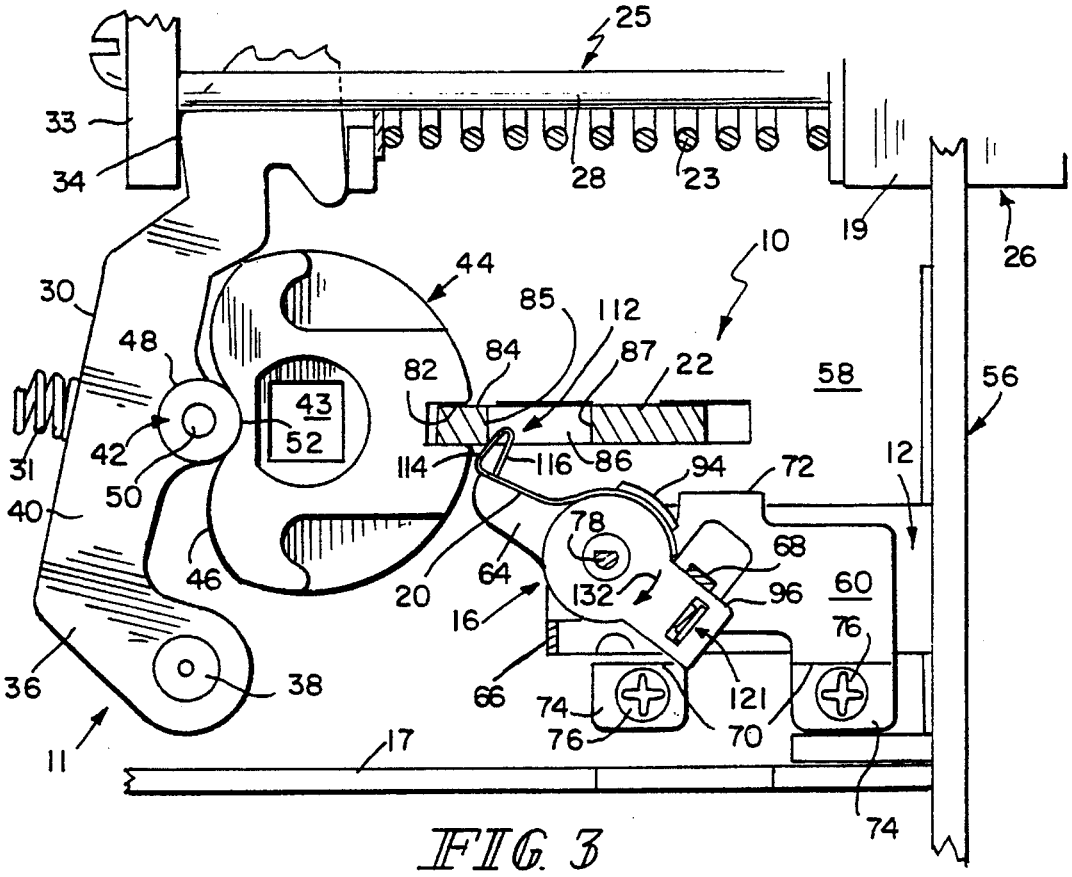
FIG. 3 is a side view of the mortise lockset of FIG. 1 (fully assembled and with one side panel of its case removed) showing the pivot hub and locking bar in a door handle-locking position.

In use, as shown in FIG. 3, the locking bar 22 can be moved to engage the outside operating hub 44 so that the hub 44 cannot rotate about its axis of rotation. As a result, the outside door handle 41 cannot be rotated to pivot the retraction lever 30 and thereby retract the latch bolt 26 into the lock case 24. As shown in FIG. 1, the outside door handle 41 includes a lever handle 43 and a lever spindle 45. The lever spindle 45 is coupled to the hub 44 to enable a user to rotate an unlocked hub 44 to retract the latch bolt 26.

The mortise lock case 24 includes a front edge face member 56 and first and second side walls 58 and 59 as shown in FIG. 1. The motor mount 14 is configured to receive the motor assembly 12 and retain the motor assembly 12 in position against the first side wall 58 of the lock case 24. Illustratively, motor assembly 12 includes a gear train 55 and a drive motor 57 connected to the gear train 55. The motor mount 14 includes a first portion 60 having a motor alignment aperture 62 and a support tab 64.

An unlocking-stop tab 66 and a locking-stop tab 68 extend perpendicularly from the first portion 60 of the motor mount 14 as shown in FIGS. 1 and 3–7. The tabs 66, 68 limit pivoting movement of the pivot hub 16 during operation of motorized actuator 10. A pair of lower motor-retaining tabs 70 extend perpendicularly from the first portion 60 so as to form a horizontal lower support for the motor assembly 12. An upper motor-retaining tab 72 extends from the first portion 60 parallel to the lower motor-retaining tabs 70, and cooperates with the lower motor-retaining tabs 70 and the first portion 60 to form a channel for receiving motor assembly 12. A mounting foot 74 extends perpendicularly from each lower motor-retaining tab 70 and mounts against side wall 58. Conventional screws 76 pass through apertures formed in the mounting feet 74 to engage the-first side wall 58 of the lock case 24 so that the motor assembly 12 is held rigidly in place in the mortise lock case 24.

The motor assembly 12 includes a D-shaped drive shaft 78 rotated by drive motor 57 and surrounded by a raised circular boss 80. When the motor assembly 12 is positioned in the_motor mount 14, the raised circular boss 80 fits into the motor alignment aperture 62 formed in the motor mount 14. Thus, the motor-retaining tabs 70, 72 and the motor alignment aperture 62 cooperate to position the motor assembly 12 properly in the lock case 24.

Figure 4:
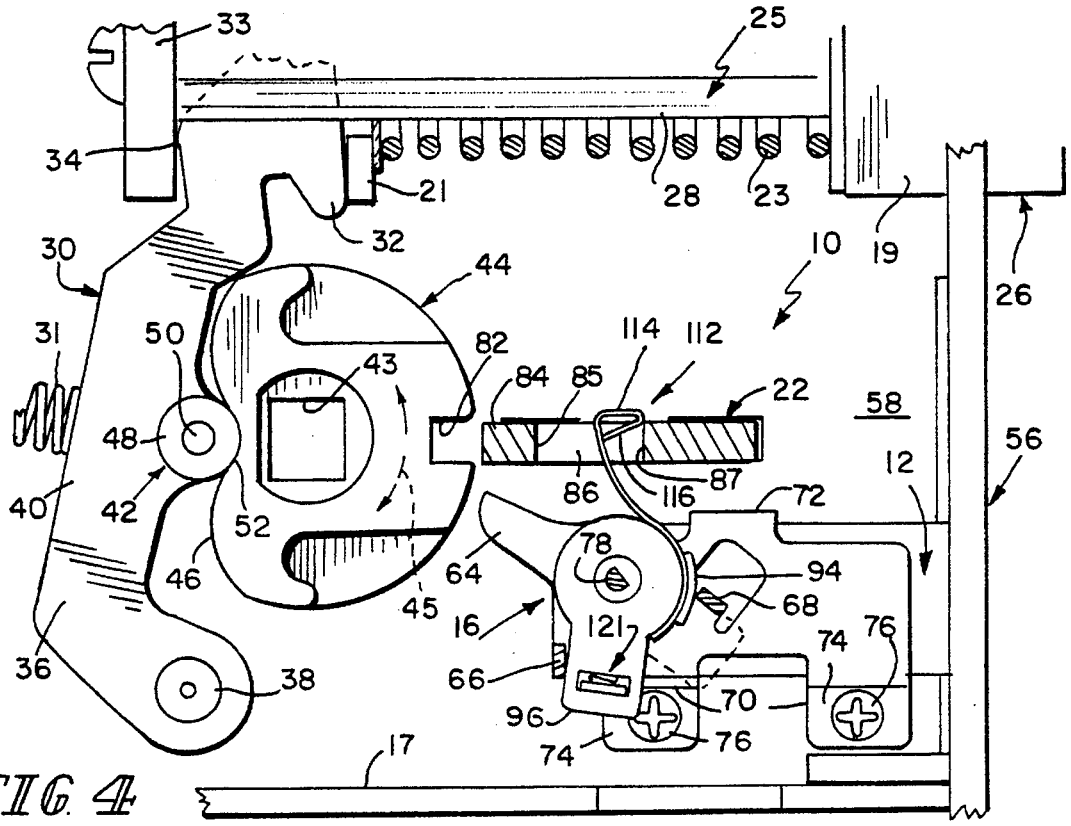
FIG. 4 is a view similar to FIG. 3 showing the pivot hub and locking bar in a door handle-unlocking position after the motor drive shaft has rotated about 60°.
Figure 5:
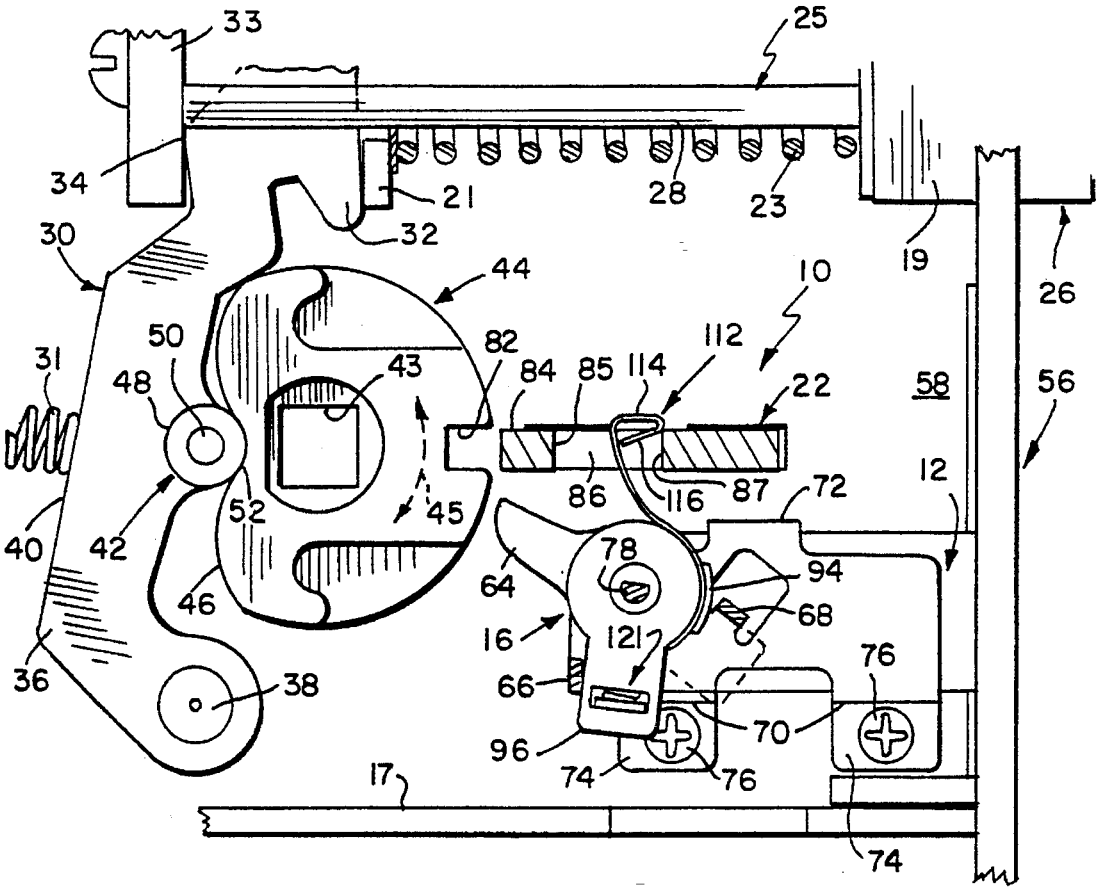
FIG. 5 is a view similar to FIG. 4 showing further rotation of the motor drive shaft by the motor without any further movement of the pivot hub and locking bar due to controlled slipping of the slip-clutch mechanism in the pivot hub.
Figure 6:
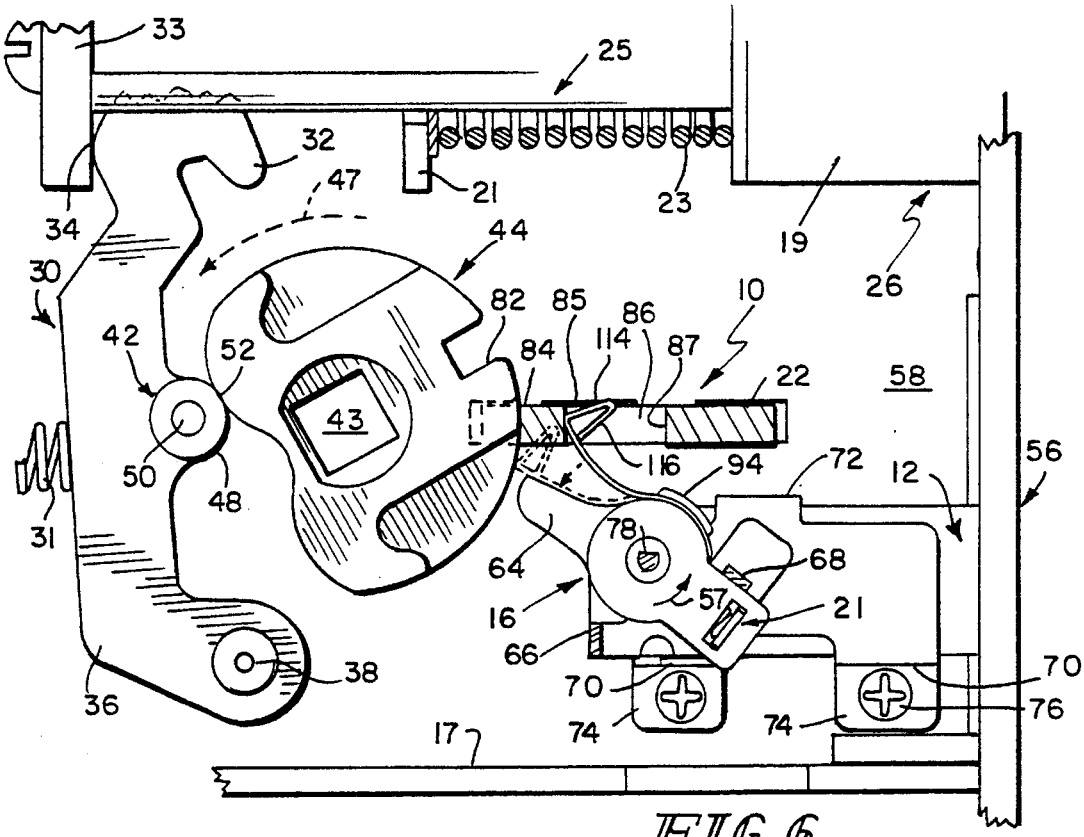
FIG. 6 is a view similar to FIG. 3 showing an obstructed locking bar bound up midway during travel from its door handle-unlocking position toward its door handle-locking position and compression of the spring.
Figure 7:
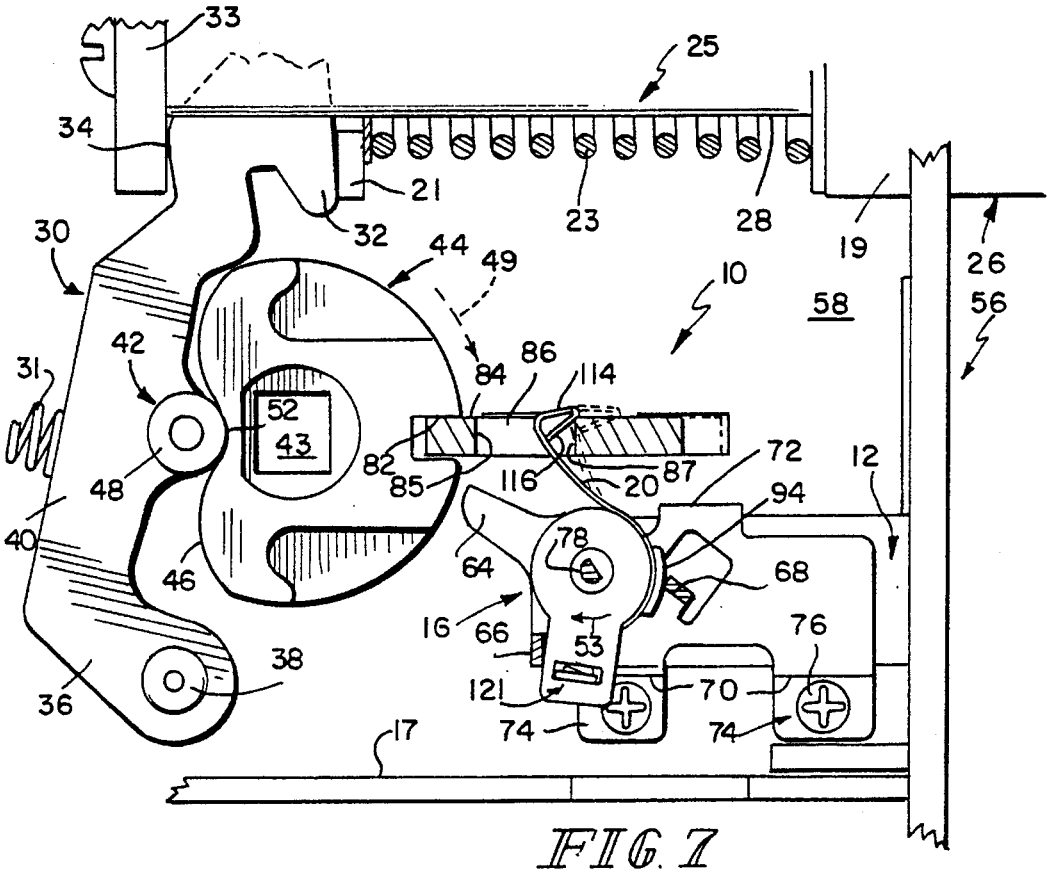
FIG. 7 is a view similar to FIG. 4 showing an obstructed locking bar bound up midway during travel from its door handle-locking position toward its door handle-unlocking position and compression of the spring.

The generally rectangular locking bar 22 is positioned in the lock case 24 above the motor assembly 12 so as to engage a locking slot 82 formed in the operating hub 44, as shown in FIGS. 3 and 7. The locking bar 22 includes a locking lug 84 sized to fit into the locking slot 82, a central aperture 86 having a front surface 85 and a rear surface 87 and being sized to receive a portion of the locking bar spring 20 as shown in FIGS. 3–7, and a plurality of lock case-engaging lugs 88. The lugs 88 are positioned to fit in slots 90 formed in the first and second side walls 58 and 59 (slots not shown in second side wall 59). The lug-receiving slots 90 provide vertical support for the locking bar 22, while allowing lateral movement of the locking bar 22 between a locked position engaging the hub 44 (as shown in FIGS. 3 and 7) and an unlocked position disengaging the hub 44 (as shown in FIGS. 4 and 5).

Figure 2:
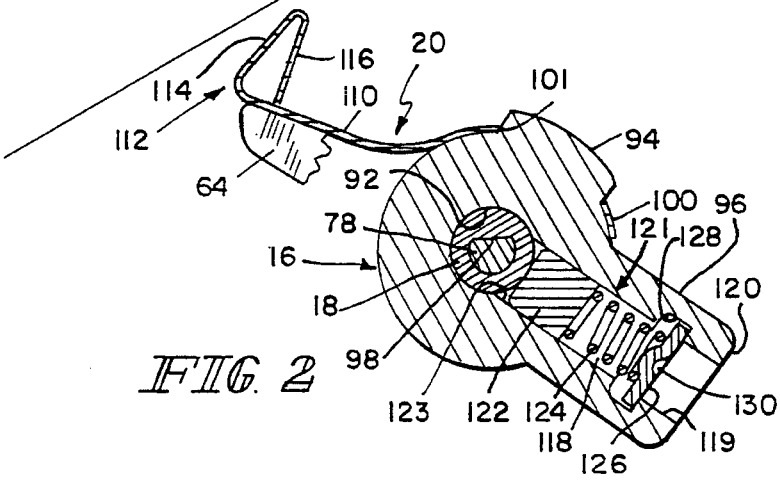
FIG. 2 is a sectional view of the pivot hub and spring showing a slip-clutch mechanism contained in an internal chamber formed in the pivot hub and arranged to engage a motor drive shaft received in an aperture formed in the pivot hub.

The pivot hub 16 includes a central aperture 92, a raised boss 94, and a clutch housing 96 extending radially-outwardly from the pivot aperture 92, as shown best in FIGS. 1 and 2. The pivot hub bearing 18 is sized to fit into the central aperture 92 while allowing the pivot hub bearing ! 8 to slip rotationally in the aperture 92. Pivot hub bearing 18 incorporates a D-shaped hole 98 extending axially therethrough for engaging the complementary D-shaped drive shaft 78 of the motor assembly 12. As shown in FIG. 3, the pivot hub 16 is positioned to lie adjacent to the first portion 60 of the motor mount 14, the cantilevered body 110 of the locking bar spring 20 is arranged to rest against the support tab 64, and the clutch housing 96 is positioned to lie between the unlocking-stop tab 66 and the locking-stop tab 68. The pivot hub bearing 18 is positioned in the central aperture 92 in the pivot hub 16 and is arranged to engage the drive shaft 78.

The locking bar spring 20 is shown best in FIGS. 1 and 2 and includes a base 100 configured to match the curved perimetral contour of the pivot hub 16. The base 100 of the spring 20 includes a window 101 configured to receive a raised boss 94 formed on the pivot hub 16. The locking bar spring 20 also includes a cantilevered body 110 extending from the base 100 in a direction generally radially outwardly from the pivot aperture 92. The cantilevered body 110 is also offset axially from the base 100 so as to rest on the support tab 64.

The radially distal end of the cantilevered body 110 includes a mechanical locking bar cam 112. The locking bar cam 112 includes a leading cam surface 114 projecting at an acute angle from the cantilevered body 110. A trailing cam surface 116 projects from the end of leading cam surface 114 and extends back to the cantilevered body 110, so that the leading cam surface 114, the trailing cam surface 116, and the cantilevered body 110 cooperate to form a "triangle" as shown best in FIG. 2.

The locking bar cam 112 engages the locking bar 22 to move the locking bar 22 into and out of the locking slot 82 of the hub 44. When the-locking bar 22 is engaged with the hub 44, clockwise rotation of the pivot hub 16 moves the locking bar cam 112 so that the trailing cam surface 116 contacts the rear surface 87 of the central aperture 86 and pulls the locking bar 22 out of the locking slot 82. Counterclockwise rotation of the pivot hub 16 moves the locking bar cam 112 so that the leading cam surface 114 contacts the front surface 85 of the central aperture 86 to push the locking bar 22 into the locking slot 82.

It has been demonstrated that locking mechanisms that rely almost entirely on appropriate spring forces to adequately retain the actual locking components in their proper functioning locations can be easily defeated by repeated vibrational attacks. The locking bar cam 112 prevents the locking bar 22 from being forced backwards during vibrational attack on the lockset 11 by providing a mechanical interference condition between the locking bar spring receiving aperture 86 and the leading cam surface 114. The leading cam surface 114 is purposely designed to encourage the locking bar spring 20 to move rotationally downward, thereby preventing the locking bar spring 20 and pivot hub 16 from rotating in a clockwise direction. Moreover, the trailing cam surface 116 serves to prevent the locking bar cam 112 from yielding when excessive force is applied, during vibrational attack on the lockset 11. Additional support to prevent the-locking bar spring 20 from being forced in a rotationally downward direction is provided by support tab 64 formed on the motor mount 14. The support tab 64 prevents the locking bar cam 112 from disengaging the central aperture 86.

A slip-clutch mechanism 121 is mounted inside pivot hub 16 as shown in FIG. 2. A cylindrical chamber 118 is formed in clutch housing 96 and extends from a first opening 119 formed in the distal end 120 of the clutch housing 96 to a second opening 123 communicating with the central aperture 92 of the pivot hub 16. A pivot hub plunger 122 is inserted into the cylindrical chamber 118 and arranged to rest against the outer surface of pivot hub bearing 18. A compression spring 124 is inserted into the cylindrical chamber 118 and held in place by pivot hub retaining plate 126 which fits a pivot hub slot 128. The pivot hub retaining plate 126 closes the cylindrical chamber 118 and retains the compression spring 124 in position against the pivot hub plunger 122, as shown in FIG. 2. The pivot hub retaining plate 126 includes a raised spherical bump 130 which serves as a spring seat and cooperates with the compression spring 124 to center and retain the pivot hub retaining plate 126 in the pivot hub slot 128. The compression spring 124 is compressed a predetermined amount to provide a slip-clutch action between the pivot hub plunger 122 the pivot hub bearing 18 as is described below.

When the motor assembly 12 is energized, it turns the drive shaft 78, which is directly coupled with the pivot hub bearing 18. Because of frictional forces existing between the pivot hub bearing 18 and the pivot aperture 92, the pivot hub 16 is rotated clockwise or counterclockwise until the pivot hub 16 comes to rest against either the unlocking stop tab 66 or the locking-stop tab 68, respectively. When the pivot hub 16 contacts one of the stop tabs 66, 68, the slip clutch mechanism 121 allows the pivot hub bearing 18 to "slip" at a predetermined torque value allowing the motor assembly 12 to continue to operate for a short period of time.

When the lockset 11 is in the locked condition, as seen in FIG. 3, the locking lug 84 of locking bar 22 is positioned in the locking slot 82 of the operating hub 44. The pivot hub 16 is in its counterclockwise-most position and the clutch housing 96 is in abutment with the locking-stop tab 68. The locking bar spring 20 is in a supported position against the support tab 64, and the leading cam surface 114 of the locking bar cam 112 is positioned against the front surface 85 of the central aperture 86.

To unlock the lockset 11 by remote control, the motor assembly 12 is actuated to turn the drive shaft 78 in clockwise direction 132 about its axis of rotation and cause the pivot hub 16 and locking bar spring 20 to rotate in direction 132 and move the locking bar 22 out of locking engagement with the hub 44. As the pivot hub 16 rotates, the locking bar spring 20 mounted on the pivot hub 16 moves relative to the locking bar 22 until the locking bar cam 112 contacts the rear surface 87 of the central aperture 86. Continued rotation of the pivot hub 16 causes the locking bar spring 20 to pull the locking bar 22 out of the locking slot 82, as shown in FIG. 4, to disengage the locking bar 22 and the hub 44 so as to unlock the lockset. At this point, the pivot hub 16 and the drive shaft 78 have rotated through an angle of approximately 60° and the clutch housing 96 contacts the unlocking-stop tab 66 to block further rotation of the pivot hub 16 about its axis of rotation.

Although the pivot hub 16 stops rotating when it contacts the unlocking-stop tab 66, the slip clutch mechanism 121 allows the drive shaft 78 to continue rotating in the central aperture 92 to complete a 360° revolution, as shown in FIG. 5. By allowing the drive shaft 78 to complete a 360° revolution, the slip clutch provides for even surface wear between the external surface of the pivot hub bearing 18 and the inner surface of the pivot aperture 92, and between the outer surface of the pivot hub bearing 18 and the pivot hub plunger 122. It also allows the motor assembly 12 to operate for a selected amount of time to minimize energy consumption so as to extend battery life and eliminate motor burn out.

The lockset 11 can be locked by reversing the above process. When the motor assembly 12 is actuated to lock the mechanism, the drive shaft 78 rotates counterclockwise, moving the pivot hub 16 with it. As the pivot hub 16 rotates, locking bar spring 20 rotates relative to the locking bar 22 until the leading cam surface contacts the front surface 85 of the central aperture 86. Continued rotation of the pivot hub 16 causes the locking bar spring 20 to push the locking bar 22 into engagement with the locking slot 82, putting the lockset in the locked condition, as shown in FIG. 3. At this point, the pivot hub 16 and the drive shaft 78 have rotated through an angle of approximately 60° and the clutch housing 96 is in contact with the locking-stop tab 68 to block further rotation of the pivot hub 16 about its axis of rotation.

At the same time, the locking bar spring 20 is supported by the support tab 64, and the leading cam surface 114 of the locking bar cam 112 is positioned against the front surface 85 of the central aperture 86. The pivot hub 16 stops rotating when it contacts the locking-stop tab 68, but the slip clutch mechanism 121 allows the drive shaft 78 to complete a 360° revolution.

Timing sensitive issues, such as misalignment or binding conditions between the applicable moving parts, can occur when a person inadvertently applies premature torque to the knob or lever handle during, or immediately before, the electric motor is energized. Timing sensitivity can cause rotational locking misalignment conditions of the outside hub 44 and the locking bar 22, as shown in FIGS. 6–7. The purposely designed electrically variable allowance of the motor assembly 12 to continue to operate for a brief time greatly reduces those timing sensitive issues by automatically urging the locking bar 22 into or out of engagement, as appropriate, when the misalignment condition is released.

The variable allowance also ensures that the pivot hub bearing 13 is rotated through a complete 360°, thereby providing an even surface area frictional distribution. This eliminates undesired isolated wear patterns between the external surface of the pivot hub bearing 18 and the inner surface of the pivot aperture 92, and between the outer surface of the pivot hub bearing 18 and the pivot hub plunger 122.

In the event of a rotational locking misalignment condition, as shown in FIG. 6, the locking bar 22 cannot be fully moved forward to its furthest locking position (as shown in FIG. 3) due to rotation of the outside hub 44 in direction 47 prior to engagement of the locking bar 22 and the locking slot 82. The "jammed" locked condition is solved by the use of the locking bar spring 20. Due to the interference condition between the locking slot 82 and the locking bar 22, the locking bar spring 20 is increasingly and rotationally urged or "flexed" in the opposite, clockwise direction, thereby storing mechanical energy in the locking bar spring 20. Meanwhile, the slip clutch mechanism 121 allows the pivot hub 16 to be rotated in counterclockwise direction 51 against the locking-stop tab 68, at which point the pivot hub bearing 18 "slips" in the pivot aperture 92. Once the outside hub 44 is returned to its proper locking position, the stored mechanical energy in the locking bar spring 20 is released, allowing the locking bar spring 20 to fully return to its original form and shape as shown in phantom lines in FIG. 6. Release of the stored mechanical energy mechanically urges the locking bar 22 forward into its locked position in the locking slot 82, thereby providing an independent, mechanical means of locking the door.

The mechanism works in a substantially similar manner in the event of a "jammed" unlocking misalignment condition, as shown in FIG. 7. In the "jammed" unlocking condition, the outside hub 44 is rotated prematurely in direction 49, causing a binding condition between the locking slot 82 and the locking bar 22. In this condition, the motor assembly 12 is actuated to rotate the drive shaft 78 and pivot hub bearing 18 in a clockwise direction 53. Due to the binding condition between the locking slot 82 and the locking bar 22, the locking bar 22 is held in the locking slot 82 and the locking bar spring 20 is increasingly and rotationally urged or "flexed" in the opposite, counterclockwise direction, thereby storing mechanical energy in the locking bar spring 20. Eventually, when the locking slot 82 is returned to the proper horizontal position to release the binding condition, the stored mechanical energy in the locking bar spring 20 is immediately released allowing the locking bar spring 20 to return to its original form and shape as shown in phantom lines in FIG. 7. The release of the stored mechanically energy of the locking bar spring 20 mechanically urges the locking bar 20 to rearward into its proper unlocked position.

Thus, a motorized mortise lockset of the present invention provides an adequate positive deadlocking feature to ensure that the lockset remains securely locked whenever it is exposed to severe vibrational attack. Furthermore, the motorized mortise lockset includes a reliable auxiliary mechanical override system for locking and unlocking the lockset when mechanisms in the lockset become misaligned or jammed. The present invention accomplishes these features by use of a mechanism designed to minimize energy consumption so that battery life is extended. Moreover, the slip-clutch mechanism eliminates the need for precise energized timing of the motor, thereby reducing the overall sensitivity of the motorized mortise lockset.

Although the invention has been described in detail with reference to a certain preferred embodiment, variations and modifications exist within the scope and spirit of the invention as described and defined in the following claims.

What is claimed is:

1. In a mortise lock including a case, a latch bolt, means for retracting the latch bolt into the case, and a locking bar movable between a locked position engaging the retracting means to block retraction of the latch bolt and an unlocked position disengaging the retracting means to allow retraction of the latch bolt, the improvement comprising means for moving the locking bar between its locked and unlocked positions, the moving means including a pivot hub having a pivot axis, a spring mounted on the pivot hub, and means for rotating the pivot hub about the pivot axis in a first direction to urge the spring into engagement with a first surface on the locking bar to move the locking bar to its locked position and in an opposite second direction to urge the spring into engagement with a second surface on the locking bar to move the locking bar to its unlocked position, the spring including a base appended to the pivot hub and cam means for engaging the first and second surfaces on the locking bar, the cam means including an angled leading cam surface engaging the first surface on the locking bar and deadlocking means for blocking vibrating movement of the angled leading cam surface away from the first surface on the locking bar.

2. The improvement of claim 1, wherein the deadlocking means includes a deadlocking member having one end appended to a distal end of the angled leading cam surface and another end contacting a portion of the spring between the base and the distal end.

3. In a mortise lock including a case, a latch bolt, means for retracting the latch bolt into the case, and a locking bar movable between a locked position engaging the retracting means to block retraction of the latch bolt and an unlocked position disengaging the retracting means to allow retraction of the latch bolt, the improvement comprising means for moving the locking bar between its locked and unlocked positions, the moving means including a pivot hub having a pivot axis, a spring mounted on the pivot hub, and means for rotating the pivot hub about the pivot axis in a first direction to urge the spring into engagement with a first surface on the locking bar to move the locking bar to its locked position and in an opposite second direction to urge the spring into engagement with a second surface on the locking bar to move the locking bar to its unlocked position, the rotating means including a rotatable drive shaft and a slip-clutch mechanism engaging the pivot hub and the rotatable drive shaft, the slip-clutch mechanism being positioned to lie in a region formed in the pivot hub.

4. The improvement of claim 3, wherein the slip-clutch mechanism includes clutch means for permitting continue rotation of the rotatable drive shaft relative to the pivot hub upon movement of the locking lug to its locked position by the spring and the clutch means interconnects the rotatable drive shaft and the pivot hub.

5. The improvement of claim 4, wherein the pivot hub is informed to include an aperture receiving the drive shaft therein and an internal chamber communicating with the aperture and containing the clutch means therein.

6. The improvement of claim 5, wherein the clutch means includes a plunger movable in the internal chamber, a retaining plate coupled to the pivot hub, and means for normally yieldably biasing the plunger into engagement with the drive shaft to establish a slippable driving connection causing rotation of the pivot hub about its pivot axis in response to rotation of the drive shaft.

7. The improvement of claim 4, wherein the rotating means further includes a motor rotating the drive shaft and the clutch means includes means for engaging the drive shaft and the pivot hub to rotate the pivot hub in response to rotation of the drive shaft by the motor and means for disengaging the engaging means upon movement of the locking bar to its locked position without blocking continue rotation of the drive shaft by the motor.

8. The improvement of claim 4, wherein the rotating means further includes a motor rotating the drive shaft and the clutch means includes means for coupling the rotating drove shaft to the pivot hub and means for yieldably urging the coupling means toward the rotating drive shaft normally to establish a driving connection that causes the pivot hub to rotate in response to rotation of the drive shaft by the motor until the locking bar is moved to its locked position and allows continued rotation of the drive shaft by the motor after the locking bar reaches its locked position.

9. The improvement of claim 3, wherein the slip-clutch mechanism includes clutch means for permitting continued rotation of the rotatable drive shaft relative to the pivot hub upon movement of the locking lug to the unlocked position by the spring and the clutch means interconnects the rotatable drive shaft and the pivot hub.

10. In a mortise lock including a case, a latch bolt, means for retracting the latch bolt into the case, and a locking bar movable between a locked position engaging the retracting means to block retraction of the latch bolt and an unlocked position disengaging the retracting means to allow retraction of the latch bolt, the improvement comprising means for moving the locking bar between its locked and unlocked positions, the moving means including a pivot hub having a pivot axis and a shaft-receiving aperture, a spring mounted on the pivot hub, a motor, and a rotatable drive shaft inserted into the shaft-receiving aperture formed in the pivot hub and rotated by the motor to rotate the pivot hub about the pivot axis in a first direction to urge the spring into engagement with a first surface on the locking bar to move the locking bar to its locked position and in an opposite second direction to urge the spring into engagement with a second surface on the locking bar to move the locking bar to its unlocked position.

11. The improvement of claim 10, wherein the moving means further includes a slip-clutch mechanism engaging and joining the rotatable drive shaft and the pivot hub.

12. The improvement of claim 10, wherein the spring includes a base appended to the pivot hub and cam means for engaging the first and second surfaces on the locking bar.

13. The improvement of claim 12, wherein the cam means includes a leading cam surface facing toward the retracting means and engaging the first surface on the locking bar during rotation of the pivot hub in the first direction and a trailing cam surface facing away from the retracting means and engaging the second surface on the locking bar during rotation of the pivot hub in the second direction.

14. The improvement of claim 13, wherein the locking bar includes a locking lug engaging the retracting means upon movement of the locking bar to its locked position and the locking bar is formed to include a central aperture receiving the cam means and lying between the first and second surfaces.

15. The improvement of claim 13, wherein the locking bar includes a locking lug engaging the retracting means and the first surface on the locking bar is arranged to lie between the locking lug and the second surface.

16. The improvement of claim 12, wherein the cam means includes a flexible cantilevered body extending away from the pivot hub and the cantilevered body has a proximal end appended to the base and a distal end arranged to lie in spaced relation to the pivot hub.

17. The improvement of claim 16, wherein the cam means further includes a leading cam surface appended to the distal end of the cantilevered body and arranged to engaged the first surface on the locking bar during rotation of the pivot hub in the first direction and a trailing cam surface appended to the leading cam surface and arranged to engage the second surface on the locking bar during rotation of the pivot hub in the second direction.

18. The improvement of claim 16, wherein the spring is a single piece of elongated spring material having the base at one end and two separate camming surfaces at the other end, a first of the camming surfaces is arranged to engage the first surface on the locking bar during rotation of the pivot hub in the first direction and is appended to the distal end of the cantilevered body, and a second of the camming surface is arranged to engage the second surface on the locking bar during rotation of the pivot hub in the second direction and is appended to the first of the camming surfaces.

19. In a mortise lock including a case, a latch bolt, means for retracting the latch bolt into the case, and a locking bar movable between a locked position engaging the retracting means to block retraction of the latch bolt and an unlocked position disengaging the retracting means to allow retraction of the latch bolt, the improvement comprising means for moving the locking bar between its locked and unlocked, positions, the moving means including a pivot hub having a pivot axis, a spring mounted on the pivot hub, and means for rotating the pivot hub about the pivot axis in a first direction to urge the spring into engagement with a first surface on the locking bar to move the locking bar to its locked position and in an opposite second direction to urge the spring into engagement with a second surface on the locking bar to move the locking bar to its unlocked position, the rotating means including a motor, a rotatable drive shaft driven by the motor, and a slip-clutch mechanism engaging and joining the rotatable drive shaft and the pivot hub, the pivot hub being formed to include an aperture receiving the drive shaft therein and an internal chamber communicating with the aperture and containing the slip-clutch mechanism therein.

20. In a mortise lock including a case, a latch bolt, means for retracting the latch bolt into the case, and a locking bar movable between a locked position engaging the retracting means to block retracting of the latch bolt and an unlocked position disengaging the retracting means to allow retraction of the latch bolt, the improvement comprising means for moving the locking bar between its locked and unlocked positions, the moving means including a pivot hub having a pivot axis, a spring mounted on the pivot hub, and means for rotating the pivot hub about the pivot axis in a first direction to urge the spring into engagement with a first surface on the locking bar to move the locking bar to its locked position and in an opposite second direction to urge the spring into engagement with a second surface on the locking bar to move the locking bar to its unlocked position, the spring including a base appended to the pivot hub and cam means for engaging the first and second surfaces on the locking bar, the cam means including a triangle shaped mechanical deadlocking leg.

21. The improvement of claim 20, wherein the base includes a distal end and the triangle shaped mechanical deadlocking leg includes a tip portion on the distal end of the base, and angled leading cam surface appended to the tip portion, and a trailing cam surface appended to the angled leading cam surface and arranged to contact the tip portion of to define the triangle shape of the mechanical deadlocking leg.

22. The improvement of claim 20, wherein the base includes a distal end and the triangle shaped mechanical deadlocking leg includes a front surface appended to the distal end and angled to provide means for engaging the first surface on the locking bar during rotation of the pivot hub in the first direction and urging the base of the spring to rotate in said first direction so that the spring and the pivot hub are blocked from rotating in the opposite second direction.

23. The improvement of claim 20, wherein the base includes a distal end and the triangle shaped mechanical deadlocking leg includes a leading cam surface appended to the distal end and arranged to engage the first surface on the locking bar during rotation of the pivot hub in the first direction and support arm means for engaging the base to block movement of the leading cam surface relative to the base during rotation of the pivot hub in the first direction.

24. In a mortise lock including a case, a latch bolt, means for retracting the latch bolt into the case, and a locking bar movable between a locked position engaging the retracting means to block retraction of the latch and bolt and an unlocked position disengaging the retracting means to allow retraction of the latch bolt, the improvement comprising means for moving the locking bar between its locked and unlocked positions, the moving means including a pivot hub having a pivot axis, a spring mounted on the pivot hub, and means for rotating the pivot hub about the pivot axis in a first direction to urge the spring into engagement with a first surface on the locking bar to move the locking bar to its locked position and in an opposite second direction to urge the spring into engagement with a second surface on the locking bar to move the locking bar to its unlocked position, the rotating means including a rotatable drive shaft and a slip-clutch mechanism engaging the pivot hub and the rotatable drive shaft, the slip-clutch mechanism including clutch means for permitting continued rotation of the rotatable drive shaft relative to the pivot hub upon movement of the locking lug to the unlocked position by the spring and the clutch means interconnects the rotatable drive shaft and the pivot hub, the pivot hub being formed to include and aperture receiving the drive shaft therein and an internal chamber communicating with the aperture and containing the clutch means therein.

25. The improvement of claim 24, wherein the clutch means includes a plunger movable in the internal chamber, a retaining plate coupled to the pivot hub, and means for normally yieldably biasing the plunger into engagement with the drive shaft to establish a slippable driving connection causing rotation of the pivot hub about its pivot axis in response to rotation of the drive shaft.

26. The improvement of claim 24, wherein the rotating means further includes a motor rotating the drive shaft and the clutch means includes means for engaging the drive shaft and the pivot hub to rotate the pivot hub in response to rotation of the drive shaft by the motor and means for disengaging the engaging means upon movement of the locking bar to its unlocked position without blocking continued rotation of the drive shaft by the motor.

27. The improvement of claim 24, wherein the rotating means further includes a motor rotating the drive shaft and the clutch means includes means for coupling the rotating drive shaft to the pivot hub and means for yieldably urging the coupling means toward the rotating drive shaft normally to establish a driving connection that causes the pivot hub to rotate in response to rotation of the drive shaft by the motor until the locking bar is moved to its unlocked position and allows continued rotation of the drive shaft by a motor.

28. In a mortise lock including a case, a latch bolt, means for retracting the latch bolt into the case, and a locking bar movable between a locked position engaging the retracting means to block retraction of the latch bolt and an unlocked position disengaging the retracting means to allow retraction of the latch bolt, the improvement comprising means for moving the locking bar between its locked and unlocked positions, the moving means including a pivot hub having a pivot axis, a spring mounted on the pivot hub, and means for rotating the pivot hub about the pivot axis in a first direction to urge the spring into engagement with a first surface on the locking bar to move the locking bar to its locked position and in an opposite second direction to urge the spring into engagement with a second surface on the locking bar to move the locking bar to its unlocked position, the rotating means including a rotatable drive shaft and a slip-clutch mechanism engaging the pivot hub and the rotatable drive shaft, the pivot hub being formed to include an aperture receiving the drive shaft therein, an internal chamber having one opening communicating with the aperture and another opposite opening, and a transverse slot communicating with said another opposite opening, the slip-clutch mechanism including a plunger movable in the internal chamber, spring means in the internal chamber for normally biasing the plunger into engagement with the drive shaft to establish a slippable driving connection causing rotation of the pivot hub about its pivot axis in response to rotation of the drive shaft, and a retaining plate positioned in the transverse slot formed in pivot hub, the retaining plate including a raised spherical bump extending into the internal chamber through said another opposite opening to provide a seat for one end of the spring means and to lock disengagement of the retaining plate from the transverse slot in the pivot hub.

29. In a mortise lock of the type including a case, a latch bolt, means for retracting the latch bolt into the case, and a locking bar movable between a locked position engaging the retracting means to block retraction of the latch bolt and an unlocked position disengaging the retracting means to allow retraction of the latch bolt, the improvement comprising means for moving the locking bar between its locked and unlocked positions, the moving means including a pivot hub having a pivot axis, a spring mounted on the pivot hub, and means for rotating the pivot hub about the pivot axis in a first direction to urge the spring into engagement with a first surface on the locking bar to move the locking bar to its locked position and in an opposite second direction to urge the spring into engagement with a second surface on the locking bar to move the locking bar to its unlocked position, the rotating means including a motor having a rotatable motor drive shaft, the pivot hub being mounted on the motor drive shaft for rotation therewith to move the sprig back and forth between the first and second surfaces on the locking bar during operation of the motor, the rotating means further including first stop means for limiting rotation of the pivot hub in the first direction so that movement of the spring in the first direction by the pivot hub is stopped at a first limit position after the locking bar has been moved to its locked position and second stop means for limiting rotation of the pivot hub in the second direction so that movement of the spring in the second direction by the pivot hub is stopped at a second limit position after the locking bar has been moved to its unlocked position, the first and second stop means being mounted in the case to lie in spaced-apart relation to one another, the pivot hub being mounted in the case to pivot between the first and second stop means, the pivot hub including a body portion formed to include aperture means for receiving the motor drive shaft and an elongated arm portion appended to the body portion and arranged to engage the first and second stop means during pivoting movement of the pivot hub, and the arm portion containing clutch means for selectively connecting the pivot hub to the motor drive shaft so that the pivot hub rotates with the motor drive shaft.

30. The improvement of claim 29, wherein the motor and pivot hub are mounted inside the case of the mortise lock.

31. The improvement of claim 29, wherein the rotating means further includes motor mount means for supporting the motor in the case and the first and second stop means are appended to the motor mount means.

32. In a mortise lock including a case, a latch bolt, means for retracting the latch bolt into the case, and a locking bar movable between a locked position engaging the retracting means to block retraction of the latch bolt and an unlocked position disengaging the retracting means to allow retraction of the latch bolt, the improvement comprising means for moving the locking bar between its locked and unlocked positions, the moving means including a pivot hub having a pivot axis, a spring mounted on the pivot hub, and means for rotating the pivot hub about the pivot axis in a first direction to urge the spring into engagement with a first surface on the locking bar to move the locking bar to its locked position and in an opposite second direction to urge the spring into engagement with a second surface on the locking bar to move the locking bar to its unlocked position, the rotating means including a motor having a rotatable motor drive shaft, the pivot hub being mounted on the motor drive shaft for rotation therewith to move the spring back and forth between the first and second surfaces on the locking bar during operation of the motor, the rotating means further including first stop means for limiting rotation of the pivot hub in the first direction so that movement of the spring in the first direction by the pivot hub is stopped at a first limit position after the locking bar has been moved to its locked position and second stop means for limiting rotation of the pivot hub in the second direction so that movement of the spring in the second direction by the pivot hub is stopped at a second limit position after the locking bar has been moved to its unlocked position, the rotating means further including motor mount means for supporting the motor in the case, the first and second stop means being appended to the motor mount means, the motor mount means being a plate formed to include an aperture, the motor being attached to one side of the plate to extend the motor drive shaft through the aperture, the pivot hub being arranged to lie on an opposite side of the plate and to rotate with the motor drive shaft, the first stop means being a first tab appended to said opposite side of the plate, and the second stop means being a second tab appended to said opposite side of the plate and arranged to lie in spaced-apart relation to the first tab.

33. In a mortise lock including a case, a latch bolt, means for retracting the latch bolt into the case, and a locking bar movable between a locked position engaging the retracting means to block retraction of the latch bolt and an unlocked position disengaging the retracting means to allow retraction of the latch bolt, the improvement comprising means for moving the locking bar between its locked and unlocked positions, the moving means including a pivot hub having a pivot axis, a spring mounted on the pivot hub, and means for rotating the pivot hub about the pivot axis in a first direction to urge the spring into engagement with a first surface on the locking bar to move the locking bar to its locked position and in an opposite second direction to urge the spring into engagement with a second surface on the locking bar to move the locking bar to its unlocked position, the rotating means including a motor having a rotatable motor drive shaft, the pivot hub being mounted on the motor drive shaft for rotation therewith to move the spring back and forth between the first and second surfaces on the locking bar during operation of the motor, the rotating means further including clutch means for permitting continued rotation of the motor drive shaft relative to the pivot hub upon movement of the locking lug to its locked position by the spring, the clutch means interconnecting the motor drive shaft and the pivot hub, the pivot hub being formed to include an aperture receiving the drive shaft therein and an internal chamber communicating with the aperture and containing the clutch means therein.

34. The improvement of claim 33, wherein the clutch means includes a plunger movable in the internal chamber, a retaining plate coupled to the pivot hub, and means for normally yieldably biasing the plunger into engagement with the motor drive shaft to establish a slippable driving connection causing rotation of the pivot hub about its pivot axis in response to rotation of the motor drive shaft.

35. The improvement of claim 33, wherein the clutch means includes means for engaging the motor drive shaft and the pivot hub to rotate the pivot hub in response to rotation of the drive shaft by the motor and for disengaging the engaging means upon movement of the locking bar to its locked position without blocking continued rotation of the motor drive shaft by the motor.

36. In a mortise lock including a case, a latch bolt, means for retracting the latch bolt into the case, and a locking bar movable between a locked position engaging the retracting means to block retraction of the latch bolt and an unlocked position disengaging the retracting means to allow retraction of the latch bolt, the improvement comprising means for moving the locking bar between its locked and unlocked positions, the moving means including a pivot hub having a pivot axis, a spring mounted on the pivot hub, and means for rotating the pivot hub about the pivot axis in a first direction to urge the spring into engagement with a first surface on the locking bar to move the locking bar to its locked position and in an opposite second direction to urge the spring into engagement with a second surface on the locking bar to move the locking bar to its unlocked position, the rotating means including a motor having a rotatable motor drive shaft, the pivot hub being mounted on the motor drive shaft for rotation therewith to move the spring back and forth between the first and second surfaces on the locking bar during operation of the motor, the rotating means further including clutch means for permitting continued rotation of the motor drive shaft relative to the pivot hub upon movement of the locking lug to its unlocked position by the spring, the clutch means interconnecting the motor drive shaft and the pivot hub, the pivot hub being formed to include an aperture receiving the drive shaft therein and an internal chamber communicating with the aperture and containing the clutch means therein.

37. The improvement of claim 36, wherein the clutch means includes a plunger movable in the internal chamber, a retaining plate coupled to the pivot hub, and means for normally yieldably biasing the plunger into engagement with the drive shaft to establish a slippable driving connection causing rotation of the pivot hub about its pivot axis in response to rotation of the drive shaft.

38. The improvement of claim 37, wherein the clutch means includes means for engaging the motor drive shaft and the pivot hub to rotate the pivot hub in response to rotation of the drive shaft by the motor and for disengaging the engaging means upon movement of the locking bar to its locked position without blocking continued rotation of the motor drive shaft by the motor.

39. In a mortise lock including a case, a latch bolt, means for retracting the latch bolt into the case, and a locking bar movable between a locked position engaging the retracting means to block retraction of the latch bolt and an unlockable position disengaging the retracting means to allow retraction of the latch bolt, the improvement comprising means for moving the locking bar between its locked and unlocked positions, the moving means including a drive shaft, motor means for rotating the drive shat about an axis, a spring having means for engaging the locking bar, and means for driving the engaging means against the locking bar during rotation of the drive shaft about its axis to compress the spring between the locking bar and the drive shaft whenever and obstruction blocks movement of the locking bar to one of its locked and unlocked positions so that a predetermined amount of potential energy is stored in the spring owing to its compressed state to enable the spring to decompress and move the locking bar to said one of its locked and unlocked positions upon removal of said obstruction without further rotation of the drive shaft, the spring further including a base and the driving means including a pivot hub, a slip-clutch mechanism connecting the pivot hub to the drive shaft for rotation therewith, and means on the pivot hub for supporting the base of the spring to project the engaging means toward the locking bar.

40. The improvement of claim 39, wherein the locking bar includes first and second surfaces and the engaging means includes a leading cam surface facing toward the retracting means and engaging the first surface on the locking bar to move the locking bar to its locked position during rotation of the pivot hub in a first direction and a trailing cam surface facing away from the retracting means and engaging the second surface on the locking bar to move the locking bar to its unlocked position during rotation of the pivot hub in an opposite second direction.

41. The improvement of claim 40, wherein the locking bar is formed to include a central aperture receiving the engaging means and lying between the first and second surfaces.

42. The improvement of claim 39, wherein the slip-clutch mechanism engages the pivot hub and the drive shaft.

43. In a mortise lock including a case, a latch bolt, means for retracting the latch bolt into the case, and a locking bar movable between a locked position engaging the retracting means to block retraction of the latch bolt and an unlocked position disengaging the retracting means to allow retraction of the latch bolt, the improvement comprising means for moving the locking bar between its locked and unlocked positions, the moving means including a drive shaft, motor means for rotating the drive shaft about an axis, a spring having means for engaging the locking bar, and means for driving the engaging means against the locking bar during rotation of the drive shaft about its axis to compress the spring between the locking bar and the drive shaft whenever an obstruction blocks movement of the locking bar to one of its locked and unlocked positions so that a predetermined amount of potential energy is stored in the spring owing to its compressed state to enable the spring to decompress and move the locking bar to said one of its locked and unlocked positions upon removal of said obstruction without further rotation of the drive shaft, the spring further including a base, the driving means including a pivot hub, means for connecting the pivot hub to the drive shaft for rotation therewith, and means on the pivot hub for supporting the base of the spring to project the engaging means toward the locking bark, the pivot hub being formed to include an aperture receiving the drive shaft therein and an internal chamber communicating with the aperture and containing the connecting means.

44. The improvement of claim 43, wherein the connecting means is a slip-clutch mechanism.

45. The improvement of claim 43, wherein the connecting means includes a plunger movable in the internal chamber, a retaining plate coupled to the pivot hub, and means for normally yieldably biasing the plunger into engagement with the drive shaft.

* * * * *